United States Patent [19]

Bergeron

[11] Patent Number: 4,958,727

[45] Date of Patent: Sep. 25, 1990

[54] SHOWCASE FOR STORING AND DISPLAYING POST-TYPE EARRINGS

[76] Inventor: Margaret A. Bergeron, 12298 Sawgrass Ct., West Palm Beach, Fla. 33414

[21] Appl. No.: 405,240

[22] Filed: Sep. 11, 1989

[51] Int. Cl.[5] ..... B65D 75/30; B65D 85/30

[52] U.S. Cl. ..... 206/6.1; 206/495; 206/489

[58] Field of Search ..... 206/6.1, 495, 486, 488, 206/489; 150/110

[56] References Cited

U.S. PATENT DOCUMENTS

| | | | |
|---|---|---|---|
| 3,525,376 | 8/1970 | Muhlhauser | 206/6.1 |
| 3,900,060 | 8/1975 | Shammas | 206/6.1 |
| 4,388,959 | 6/1983 | Handy et al. | 206/6.1 |
| 4,401,219 | 8/1983 | Mink | 206/495 |
| 4,465,179 | 8/1984 | Miller | 206/45.14 |
| 4,606,458 | 8/1986 | LaBate | 206/486 |
| 4,720,012 | 1/1988 | Dufour | 206/495 |
| 4,760,920 | 8/1988 | Thomsen | 206/495 |
| 4,821,883 | 4/1989 | Miller | 206/495 |
| 4,848,585 | 7/1989 | Snyder | 206/315.11 |
| 4,848,586 | 7/1989 | Jasik | 206/495 |

*Primary Examiner*—Paul T. Sewell
*Assistant Examiner*—David Jenny

[57] ABSTRACT

A showcase comprising a flexible rectangular cover sheet, a flexible substantially-rectangular mounting sheet having holes therein, and a flexible substantially-rectangular spacer sheet; all bound together along folds therein with stitching. A stiffener is integral with and adjacent to the edge of the cover sheet, and a flexible hanger strap is attached at its ends adjacent to the top corners of the cover sheet. A first closure pair, attached adjacent to the top edges of the cover sheet and mounting sheet, normally holds them together. Second and a third closure pairs, attached adjacent to the top and bottom corners on each side of the cover sheet, holds the showcase together in the trransport mode, but can be easily opened to convert the showcase to the display mode.

5 Claims, 2 Drawing Sheets

SHOWCASE FOR STORING AND DISPLAYING POST-TYPE EARRINGS

BACKGROUND OF THE INVENTION

1. Field of the Invention

This invention relates to a showcase for storing and displaying post-type earring. The novel showcase is designed for travelers whereby it is easily converted to and from the closed storage-and-transport mode and the open, hangable display mode. The novel showcase is especially useful for receiving large, dangly earrings therein.

2. Description of the Prior Art Earrings are common adornments worn by men and women on their person. One type that is in common use is the post-type earring, which is used by persons with pierced ear lobes. A post-type earring includes a decorative portion which is supported on a post, which post is inserted in the ear lobe of the wearer. A dangly earring includes a decorative portion that is large relative to the ear lobe, and dangles loosely below the post.

As a result of the attractiveness of wearing dangly earrings, many people, especially women, have acquired fairly large collections of post-type earrings in matched pairs for use in combination with particular outfits of attire. When going on a trip, earring wearers take along a plurality of matched pairs of earrings to be worn on different occasions during the trip. It is not satisfactory to place these earrings, especially dangly earrings, loosely in a bag or purse, because they may become scratched, broken, bent or stuck together while they are being transported in the wearers baggage. Also, where many matched pairs are mixed together, a particular pair may be difficult to find. Several solutions to this problem have been proposed.

U.S. Pat. No. 4,465,179 to B. A. Miller discloses a zippered purse having an attached tab in which post-type earrings can be mounted. Because of its size, only a few small earrings can be mounted on the tab. Also, the tab is not adapted for mounting large dangly earrings.

U.S. Pat. No. 4,720,012 to H. Dufour discloses a jewelry holder in the form of a loose-leaf notebook. The holder includes a ring binder with padded front and back covers, two mesh pages on which post-type earrings can be mounted, and a cushioned separator page between the mesh pages. The pages are holed and are held on the rings of the binder by the holes herein. The binder is provided with a tab having a Velcro closure pair for releasable holding the binder covers together. While this holder can accommodate large, dangly earrings, it is not adapted for a modern travelers needs. The stiff binder cover and pages therein results in a bulky, relatively heavy mass that is not suitable for modern travel. Also, the holder is not adapted to be hung, as on a wall, or from a coat hanger.

U.S. Pat. No. 4,821,883 to K. M. Miller discloses a foldable jewelry holder comprising a flexible rectangular sheet of mesh-type material bonded to a sheet of craft foam. A stiff wire is sewn along one minor edge of the composite sheet so that the composite sheet can be rolled up from the one minor edge and tied together with the cords attached near the other minor edge. While this jewelry holder is flexible, is adapted by its felxibility and weight for modern travel, is not bulky, and is hangable; it is not adapted for storing and displaying large, dangly earrings.

OBJECTS OF THE INVENTION

An object of this invention is to provide a novel showcase for storing and displaying large, dangly post-type earrings.

A further object is to provide a novel showcase which is not bulky, is hangable, and is easily converted to and from the closed storage-and-transport mode and the open, hangable display mode.

Another object is to provide a novel showcase which is flexible, relatively light in weight and is otherwise adapted for a modern travelers needs.

SUMMARY OF THE INVENTION

The foregoing and other objects may be achieved with the novel showcase comprising a flexible rectangular cover sheet; a flexible, substantially-rectangular, perforated mounting sheet, and a flexible substantially rectangular spacer sheet. The cover sheet and mounting sheets have folds about half-way between and substantially parallel to the top and bottom edges thereof. The spacer sheet, which is smaller than the other sheets, has a fold adjacent and substantially parallel to the top edge of the spacer sheet.

The folds in the spacer sheet, the mounting sheet and the cover sheet are superimposed on one another in that order and are bound together with stitching along the superimposed folds. A stiffener, which may be a metal wire or a stiff fabric, is integral with and adjacent to the top edge of the cover sheet. Also, a flexible hanger strap is attached at the ends thereof adjacent to the corners of the cover sheet adjacent to the top edge of the cover sheet.

The novel showcase includes a first hook-and-loop (VELCRO) closure pair attached in opposed positions adjacent to the top edges of the cover sheet and the mounting sheet. A second hook-and-loop (VELCRO) closure pair is attached in opposed positions adjacent to the top and bottom corners on one side of the cover sheet. A third hook-and-loop (VELCRO) closure pair is attached in opposed positions adjacent to the top and bottom covers on the other side of the cover sheet.

In the transport mode, the novel showcase is folded with the top and bottom edges of the cover sheet held together by the second and third closure pairs. The strap may be used for carrying, like a ladies handbag, if desired. When the novel showcase is carried by the strap in the transport mode, the fold in the cover sheet is downward, thereby preventing any of the contents from dropping out of the edges thereof.

The novel showcase is easily converted from the transport mode to display mode by manually pulling apart the second and third closure pairs, and supporting t the novel showcase by the strap. The bottom edges of the cover sheet, the mounting sheet and the spacer sheet hang downward from the stiching; the top edge of the mounting sheet is held to the top edge of the cover sheet by the first closure pair; and the top edge of the cover sheet is held flat by the stiffness of the stiffener.

Earrings may be mounted on or removed from the top portion of the mounting sheet by manually pulling apart the first closure pair, making the change, and then reclosing the first closure pair. Earings may be mounted on or removed from the bottom portion of the mounting sheet by manually raising the spacer sheet, making the change, and then allowing the spacer sheet to hang down. The posts of the earrings are mounted in the perforations in the mounting sheet. The novel showcase may be returned to the transport mode by reclosing the second and third closures.

Thus, there is provided a novel showcase which can achieve each of the above-stated objects. In some preferred forms of the invention, the cover sheet has a composite structure including a decorative outer layer and a puncture-resistant inner layer adjacent to the mounting sheet. In other preferred forms of the invention, the cover sheet extends beyond and overlaps the mounting and spacer sheets. Also, in some forms of the invention, one closure portion of each of the closure pairs is in a common closure strip attached to the cover sheet extending substantially the entire cover sheet width adjacent to the top edge thereof.

DETAILED DESCRIPTION OF THE INVENTION INCLUDING THE PREFERRED EMBODIMENTS

Figure 1:
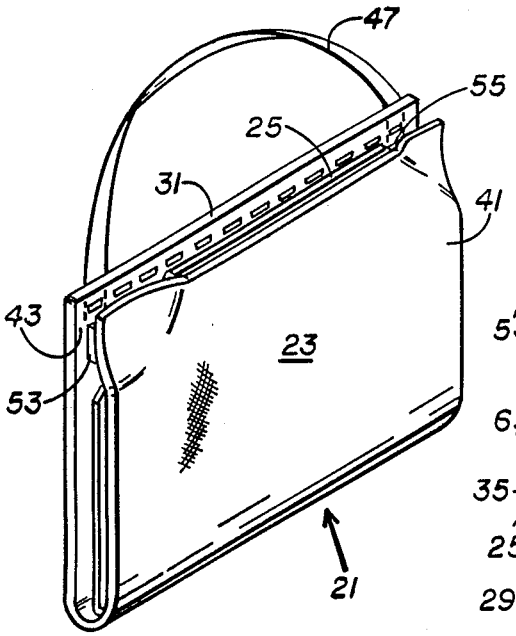
FIG. 1 is a perspective view of a preferred embodiment of the novel showcase in the transport mode.

The following description of some of the preferred embodiments of the concepts of this invention is made in reference to the accompanying figures. When an individual structural element is depicted in more than one figure, it is assigned a common reference numeral for simplification of identification and understanding.

Figure 2:
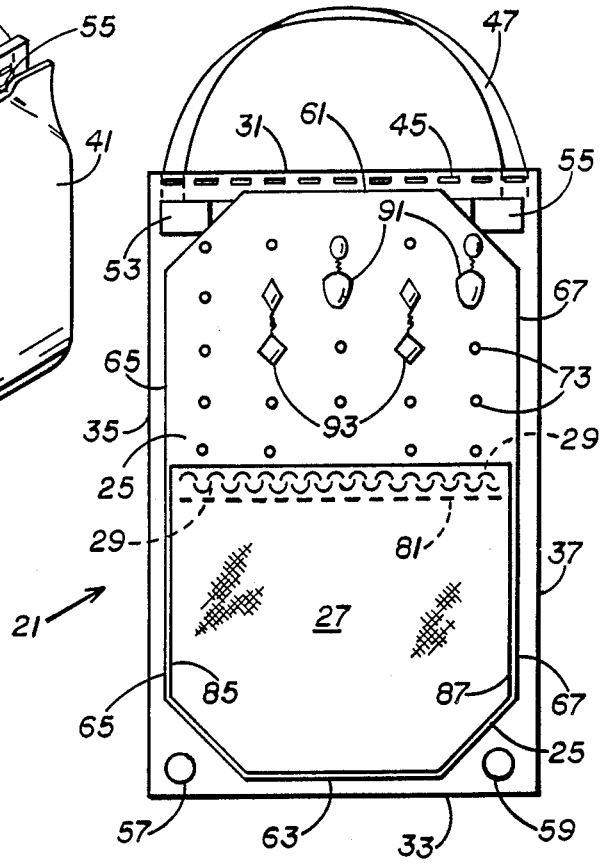
FIG. 2 is an elevational view of the embodiment shown in FIG. 1 in the display mode.

Referring to FIGS. 1 and 2, the novel showcase 21 comprises a flexible rectangular cover sheet 23, a flexible, substantially-rectangular mounting sheet 25, and a flexible, substantially-rectangular spacer sheet 27, all bound together with stitching 29. The cover sheet 23, which is shown separately in FIG. 3 prior to assembly with the mounting sheet 25 and spacer sheet 27, is about 12 inches wide and about 18 inches long. The mounting sheet 25, which is shown separately in FIG. 4 prior assembly, is about 11 inches wide and 17 inches long, so that upon assembly, the cover sheet 23 overlaps the mounting sheet in both the width and the length. The spacer sheet 27, shown separately in FIG. 5 prior to assembly, is about 11 inches wide and about 8 inches long.

The cover sheet 23 has a top cover sheet edge 31, a bottom cover sheet edge 33 with the cover sheet length therebetween, and left and right side cover sheet edges 35 and 37 respectively with the cover sheet width therebetween. The cover sheet 23 has a cover-sheet fold 39 therein about half way between and substantially parallel to the top and bottom cover-sheet edges 31 and 33.

Figure 3:
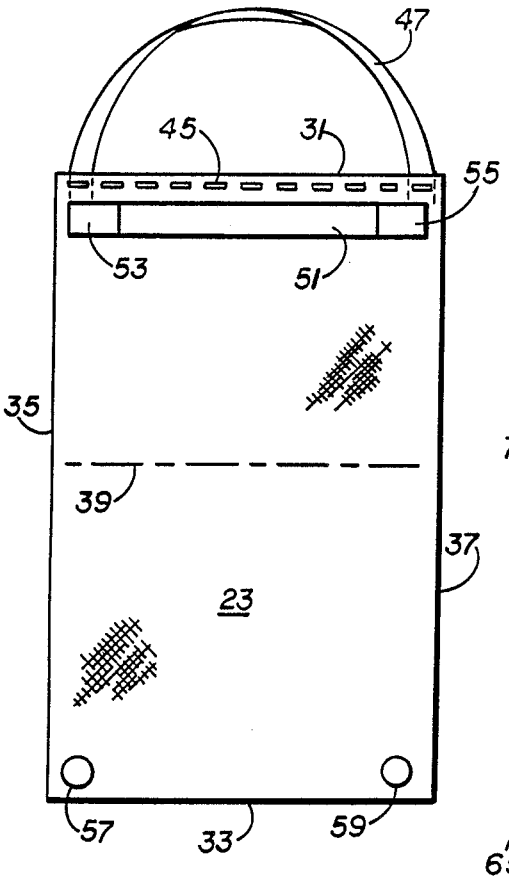

The cover sheet 23 may be cut from a sheet of a single material but, as shown in FIGS. 1, 2 and 3, is made of a composite structure including a flexible decorative outer layer 41 and a flexible puncture-resistant inner layer 43 suitably attached to the decorative layer 41. The outer layer 41 may be made, for example, of leather, or a natural fabric such as velvet, or a solid synthetic material, or of a woven synthetic material. The pucture-resistant inner layer 43 may be made, for example, of a tightly-woven fabric such as a satin, or of a tightly-packed fibrous material such as a felt. The inner layer 43 should resist puncturing by the parts of the earrings mounted on the mounting sheet 25 and provides substantial protection from damage of earrings stored in novel showcase 21. The preferred embodiment includes a leather outer layer 41 and a satin inner layer 43.

The cover sheet 23 has a stiffener 45 integral therewith and extending adjacent to the top cover sheet edge 31 over substantially the entire width of the cover sheet. As shown in FIGS. 2 and 3, the stiffener 45 is a metal wire or rod. The stiffener 45 may also be a stiff fabric, such as a buckram, which may be sewn or sealed to the cover sheet 23.

The cover sheet 23 also has a flexible hanger strap 47, attached, preferably by stiching, at the ends thereof to the cover sheet 23 adjacent to the top cover-sheet edge 31 and adjacent to the side cover-sheet edges 35 and 37. The strap 47 may be made of any strong material and, preferably, should aesthestically match the decorative outer layer 41.

The cover sheet 23 also has one closure portion 51 of a first hook-and-loop (VELCRO) closure pair attached adjacent to the top cover-sheet edge 31, one closure portion on 53 of a second hook-and-loop (VELCRO) closure pair adjacent to the cover-sheet corner between the top edge 31 and the left side cover-sheet edge 35, and one closure portion 55 of a third hook-and-lop (VELCRO) closure pair adjacent to the cover-sheet corner between the top edge 31 and the right side cover-sheet edge 37. As shown in FIGS. 2 and 3, these three closure portions 51, 53 and 55 are integrated into a single VELCRO strip which is sewn or sealed to the cover sheet 23.

The cover sheet 23 also has the other closure portion 57 of the second hook-and-look closure pair attached adjacent to the cover-sheet corner between the bottom cover-sheet edge 33 and the left side cover-sheet edge 35, and has the other closure portion 59 of the third hook-and-loop closure pair attached adjacent to the cover-sheet corner between the bottom cover-sheet edge 33 and the right side cover-sheet edge 37.

Figure 4:
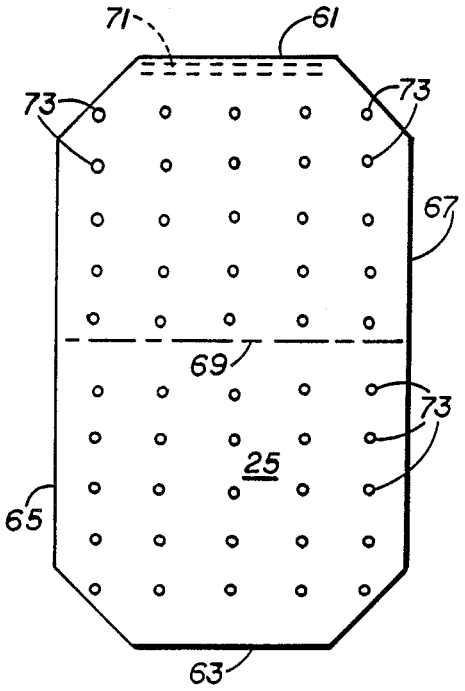

The mounting sheet 25 has a top mounting-sheet edge 61, a bottom mounting sheet edge 63 with the mounting sheet length therebetween; and left and right side mounting-sheet edges 65 and 67 respectively with the mounting sheet width therebetween. The mounting sheet has a mounting sheet fold 69 therein about halfway between and substantially parallel to the top and bottom mounting-sheet edges 61 and 63. Each of the mounting-sheet corners is truncated (cut off) at about a 450 angle, as shown in FIGS. 2 and 4, so that it does not interfere with the closure portions 53, 55, 57 and 59 of the second and third closure pairs. The mounting sheet has the other hook-and-loop closure portion 71 of the first closure pair attached to the back side thereof and opposite the one closure portion 51 on the cover sheet 23. The other closure portion 71 attached to the mounting sheet 23 is in the form of a strip parallel and adjacent to the top mounting sheet edge 61 and extending most of the width between the truncated corners of the mounting sheet 23.

The mounting-sheet 23 has an array of holes 73 therein of such size as to be capable of receiving and holding the posts of post-type earrings therein. The holes 73 may be in any order, array or arrangement that may be desired. The mounting-sheet 23 may be made of a relatively stiff but flexible mesh which has the holes therein in a regular array. Or, the mounting sheet 23 may be made of a flexible solid sheet into to which holes or perforations have been formed in a desired array.

Figure 5:
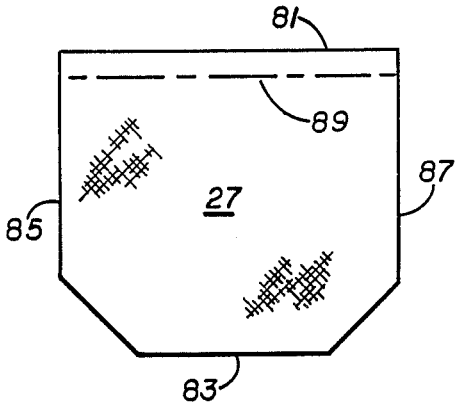
FIG. 3, 4 and 5 are plan views of the cover sheet, the mounting sheet and the spacer sheet respectively prior to assembly into the preferred embodiment shown in FIGS. 1 and 2.

The spacer sheet 27 has a top spacer-sheet edge 81, a bottom spacer-sheet edge 83 with the spacer sheet length therebetween; and left and right side spacer-sheet edges 85 and 87 respectively with the spacer sheet width therebetween. The spacer sheet 27 has a spacer-sheet fold 89 therein adjacent to the top spacer-sheet edge 81 and substantially parallel to the top and bottom spacer-sheet edges 81 and 83. Each of the bottom spacer-sheet corners is truncated (cut off) at about a 45° angle, as shown in FIGS. 2 and 5, so that the spacer sheet 27 does not interfere with the closure portions 53, 55, 57 and 59 of the second and third closure pairs.

The spacer sheet 27 is of a material that resists puncturing by the parts of the earrings mounted on the mounting sheet 25 and provides substantial protection from damage to earrings stored in the novel showcase 21. A tightly packed fibrous material, such as a felt, is preferred. Also, a composite of many fabric layers sewn together can be used. However, sheet foam cut to size is not desirable as it deteriorates rapidly from manual handling.

The three sheets 23, 25 and 27 are assembled by placing the folds 39, 69 and 89 in the desired order and orientation and then sewn together with stitching 29. As shown in FIG. 2, the spacer sheet 27 was sewn face down against the mounting sheet 25 so that the spacer sheet 27 bends over the stiching 29 and the top spacer-sheet edge 81 is concealed by the spacer sheet 27.

FIG. 2 shows the novel showcase supported on it strap 47 with a first earring pair 91 and a second earring pair 93 mounted therein above the stiching 29. The earring pairs 91 and 93 were mounted by, first, manually pulling apart the positions 51 and 71 of the first closure pair. Then, inserting the respective posts of the earrings into the holes 73 of the mounting sheet 25, and replacing the earring locks on the earring posts. Then, manually pressing together the portions 51 and 71 of the first closure pair. The earrings 91 and 93 may be removed from the mounting sheet by a similar reverse procedure.

Earrings (not shown) may be mounted in or removed from the mounting sheet 25 below the stiching 29 simply by raising the spacer sheet 27 and mounting sheet 25 manually and then inserting or removing the earring parts as desired.

To close the showcase 21, the spacer sheet 27 is manually held against the lower portion of the mounting sheet 25 and the lower portion of the cover sheet 23 in the relative positions shown in FIG. 2, and the lower portions of the three sheets rotated about the stiching 29 so that the bottom cover sheet edge 33 is opposite the top cover sheet edge 31. Then, the closure portions 53 and 57 respectively, and 55 and 59 pressed together as shown in FIG. 1. The showcase 21 can be opened by reversing this procedure.

The foregoing figures and descriptions thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A hangable showcase for displaying large, dangly post-type earrings, comprising:

a flexible rectangular cover sheet having a top cover sheet edge and a bottom cover sheet edge defining a cover length therebetween; side cover sheet edges defining a cover sheet width therebetween, said cover sheet having a cover sheet fold therein about half way between and substantially parallel to said top and bottom cover sheet edges;

a flexible, substantially-rectangular perforated mounting sheet adapted for receiving and holding the posts of said post-type earrings, said mounting sheet having a top mounting sheet edge and a bottom mounting sheet edge defining a mounting sheet length, and side mounting sheet edges defining a mounting sheet width therebetween, said mounting sheet having a mounting sheet fold therein about half way between and substantially parallel to said top and bottom mounting sheet edges;

a flexible, substantially rectangular spacer sheet having a top spacer sheet edge and a bottom spacer sheet edge defining a spacer sheet length therebetween; and side spacer sheet edges defining a spacer sheet width therebetween, said spacer sheet having a spacer sheet fold therein adjacent to said top spacer sheet edge and substantially parallel to said top and bottom spacer sheet edges;

said mounting sheet fold being superimposed on said cover sheet fold and said spacer sheet fold being superimposed on said mounting sheet fold, said cover sheet, mounting sheet and spacer sheet being permanently attached along said superimposed folds;

a first hook-and-loop closure pair attached in opposed positions to said mounting sheet across the width thereof adjacent to said top mounting sheet edge, and to said cover sheet across the width thereof adjacent to said top cover sheet edge;

a second hook-and-loop closure pair attached in opposed positions to said cover sheet adjacent to said top and bottom cover sheet edges and adjacent to one of said cover sheet sides;

a third hook-and-loop closure pair attached in opposed positions to said cover sheet adjacent to said top and bottom cover sheet edges and adjacent to the other of said cover sheet sides.

2. The showcase defined in claim 1 wherein said top cover-sheet edge overlaps said top mounting-sheet edge, and said bottom cover-sheet edge overlaps said bottom mounting sheet edge.

3. The showcase defined in claim 1 wherein one closure portion of each of said closure pairs is in a common closure strip attached to said cover sheet extending substantially the entire cover-sheet width adjacent to said top cover-sheet edge.

4. The showcase defined in claim 3 wherein triangular corner portions of said top mounting-sheet edge, said bottom mounting sheet edge, and said bottom spacer-sheet edge are removed to expose the ends of said closure strip.

5. The showcase defined in claim 1 wherein said cover sheet has a composite structure including a decorative outer layer and a puncture-resistant inner layer adjacent to said mounting sheet.

* * * * *